US008499481B2

(12) United States Patent
Laney et al.

(10) Patent No.: US 8,499,481 B2
(45) **Date of Patent: *Aug. 6, 2013**

(54) BREECH PLUG

(75) Inventors: Mark C. Laney, Lee, NH (US); Gene L. Garland, New Durham, NH (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/570,754

(22) Filed: Aug. 9, 2012

(65) Prior Publication Data

US 2012/0304519 A1 Dec. 6, 2012

Related U.S. Application Data

(63) Continuation of application No. 12/570,723, filed on Sep. 30, 2009, now Pat. No. 8,261,478, which is a continuation-in-part of application No. 11/316,116, filed on Dec. 21, 2005, now Pat. No. 7,621,064.

(51) Int. Cl.
*F41C 9/08* (2006.01)

(52) U.S. Cl.
USPC ..... 42/51

(58) Field of Classification Search
USPC ..... 42/51, 83
See application file for complete search history.

(56) References Cited

U.S. PATENT DOCUMENTS 484,012 A 10/1892 Haskell
648,767 A 5/1900 Meigs et al.
2,075,837 A 4/1937 Studler
2,473,555 A 6/1949 Weiss
2,531,483 A 11/1950 Rhein et al.
2,925,601 A 2/1960 Pfaff et al.
2,972,800 A 2/1961 Sterba et al.
3,016,539 A 1/1962 Marsh et al.
3,060,435 A 10/1962 Ivins et al.
3,103,013 A 9/1963 Lewis et al.
3,155,980 A 11/1964 Mulno et al.
3,297,224 A 1/1967 Osborne
3,724,114 A 4/1973 Jones et al.
3,797,153 A 3/1974 Hagan
3,815,503 A 6/1974 Infantino
4,065,866 A 1/1978 Eguizabal
4,222,191 A 9/1980 Lee et al.
4,437,249 A 3/1984 Brown et al.
4,519,157 A 5/1985 Giangerelli
4,586,422 A 5/1986 Magoon
4,660,312 A 4/1987 A'Costa
4,854,065 A 8/1989 French et al.
5,010,677 A 4/1991 Verney Carron
5,305,679 A 4/1994 Begneu (Continued)

*Primary Examiner* — Bret Hayes
(74) *Attorney, Agent, or Firm* — Ballard Spahr LLP

(57) ABSTRACT

A muzzle loading firearm has a barrel with a bore on a bore axis, and has a muzzle end and a breech end. A frame is connected to the barrel, and has a breech face. The frame moves between an open position in which the breech face is away from the breech end of the barrel, and a closed position in which the breech face abuts the breech end of the barrel. A breech plug is removably attached to the barrel, and is connected to the barrel by way of interrupted, or multistart threads, or locking lugs. The breech plug may have a rear face that abuts the breech face when the frame is closed, so that a primer contained in a primer pocket in the rear of the breech plug is fully supported on all sides.

6 Claims, 3 Drawing Sheets

U.S. PATENT DOCUMENTS

| | | | | |
|---|---|---|---|---|
| 5,615,507 | A | 4/1997 | French | |
| 5,639,981 | A | 6/1997 | French | |
| 5,680,722 | A | 10/1997 | French et al. | |
| 5,737,863 | A | 4/1998 | Rainey, III | |
| 5,782,030 | A | 7/1998 | French | |
| 5,907,920 | A | 6/1999 | Laney | |
| 6,145,235 | A | 11/2000 | Emerson et al. | |
| 6,219,951 | B1 | 4/2001 | Cate | |
| 6,532,692 | B2 | 3/2003 | Cate | |
| 6,604,311 | B1 | 8/2003 | Laney et al. | |
| 6,834,455 | B2 | 12/2004 | Burigana | |
| 7,140,138 | B1 | 11/2006 | Laney et al. | |
| 7,257,917 | B1 | 8/2007 | Garland | |
| 7,353,631 | B2 | 4/2008 | Calvete Zumalde | |
| 7,621,064 | B2 | 11/2009 | Laney et al. | |
| 2006/0248771 | A1 | 11/2006 | Richards | |
| 2007/0028499 | A1 | 2/2007 | DeLeeuw | |
| 2007/0163162 | A1 | 7/2007 | Laney et al. | |
| 2011/0138669 | A1* | 6/2011 | Laney et al. | 42/51 |
| 2012/0192473 | A1* | 8/2012 | Laney et al. | 42/51 |

* cited by examiner

BREECH PLUG

CROSS-REFERENCE TO RELATED APPLICATIONS

This application is a continuation of, and claims priority to, U.S. patent application Ser. No. 12/570,723 entitled "MUZZLE LOADING RIFLE WITH REMOVABLE BREECH PLUG", filed on Sep. 30, 2009 (now U.S. Pat. No. 8,261,478, issued Sep. 11, 2012) which is itself a Continuation-in-Part of, and claims priority to, U.S. patent application Ser. No. 11/316,116 entitled "MUZZLE LOADING RIFLE WITH REMOVABLE BREECH PLUG", filed on Dec. 21, 2005, (now U.S. Pat. No. 7,621,064, issued Nov. 24, 2009) each of which are hereby incorporated by reference in their entireties.

FIELD OF THE INVENTION

This invention relates to firearms, and more particularly to muzzle loading firearms.

BACKGROUND AND SUMMARY OF THE INVENTION

Muzzle loading rifles have an essentially closed breech at the rear of the barrel, so that powder and bullets must be loaded at the muzzle or forward end of the barrel. A typical muzzle loading rifle has a barrel with a breech plug attached to occupy an enlarged rear bore portion of the barrel at the breech end. In some rifles, the breech plug is permanently attached. In others, the breech plug is removable to facilitate pass-through cleaning of the bore.

One type of removable breech plug plus is one that centers in the bore with an O-ring, but which relies on the rear support of the standing breech of the break-open action to retain it against the forces of discharge.

A safer existing removable breech plug employs a finely threaded body that screws into the rear of the barrel, with 10-15 turns to secure it in place. This provides safety against hang fires and facilitates removal for cleaning. However, the number of turns requires significant undesirable time and effort to remove and replace the plug. Moreover, the fouling associated with muzzle loading rifles can clog the threads, requiring undesirably great torque to remove the plug, through the many rotations required.

In addition, existing muzzle loading rifle breech plugs that use shotgun style primers do not fully support the primer used for firing. Such breech plugs have a rear face defining a central bore that receives a primer. The primer is a cylinder with a rear flange. However, because an extractor lip needs to be positioned between the primer flange and the breech plug's rear face, the flange of the primer is spaced apart from the breech plug's rear face by the thickness of the extractor lip. This portion is unsupported, and presents a risk of rupture when firing, allowing unwanted fouling to occur.

Because unloading a muzzle loading rifle via the muzzle is difficult or time consuming without discharging the rifle, and requires special tools, some shooters may be tempted to leave a loaded rifle in an unsafe charged condition. Conventional removable breach plugs may be used to unload via the breech, however these have the speed and convenience disadvantages noted above.

The present invention overcomes the limitations of the prior art by providing a muzzle loading firearm. The firearm has a barrel with a bore on a bore axis, and has a muzzle end and a breech end. A frame is connected to the barrel, and has a breech face. The frame moves between an open position in which the breech face is away from the breech end of the barrel, and a closed position in which the breech face abuts the breech end of the barrel. A breech plug is removably attached to the barrel, and is connected to the barrel by way of interrupted, multistart threads, or any type of quick detachable locking lugs. The breech plug may have a rear face that abuts the breech face when the frame is closed, so that a primer contained in a primer pocket in the rear of the breech plug is fully supported on all sides.

DETAILED DESCRIPTION OF A PREFERRED EMBODIMENT

Figure 1:
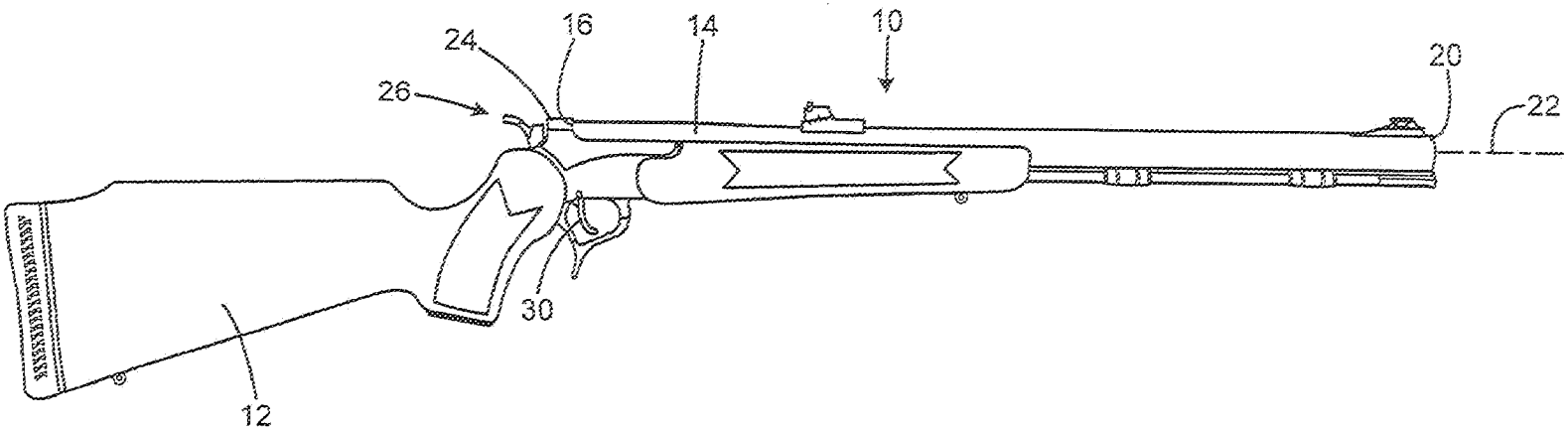
FIG. 1 is a side view of a firearm according to a preferred embodiment of the invention.

FIG. 1 shows a muzzle-loading firearm 10, with a stock 12 and a barrel 14 having a breech end 16 and a muzzle end 20, and having a bore defining a bore axis 22. A movable breech element 24 pivots between an open position and a closed (shown) position. A hammer 26 is pivotally connected adjacent the breech block to operate in response to operation of a trigger 30 as will be discussed below. A muzzle loading firearm having some similar features is disclosed in U.S. Pat. No. 6,604,311 to Laney et al., the disclosure of which is incorporated herein by reference.

Figure 2:
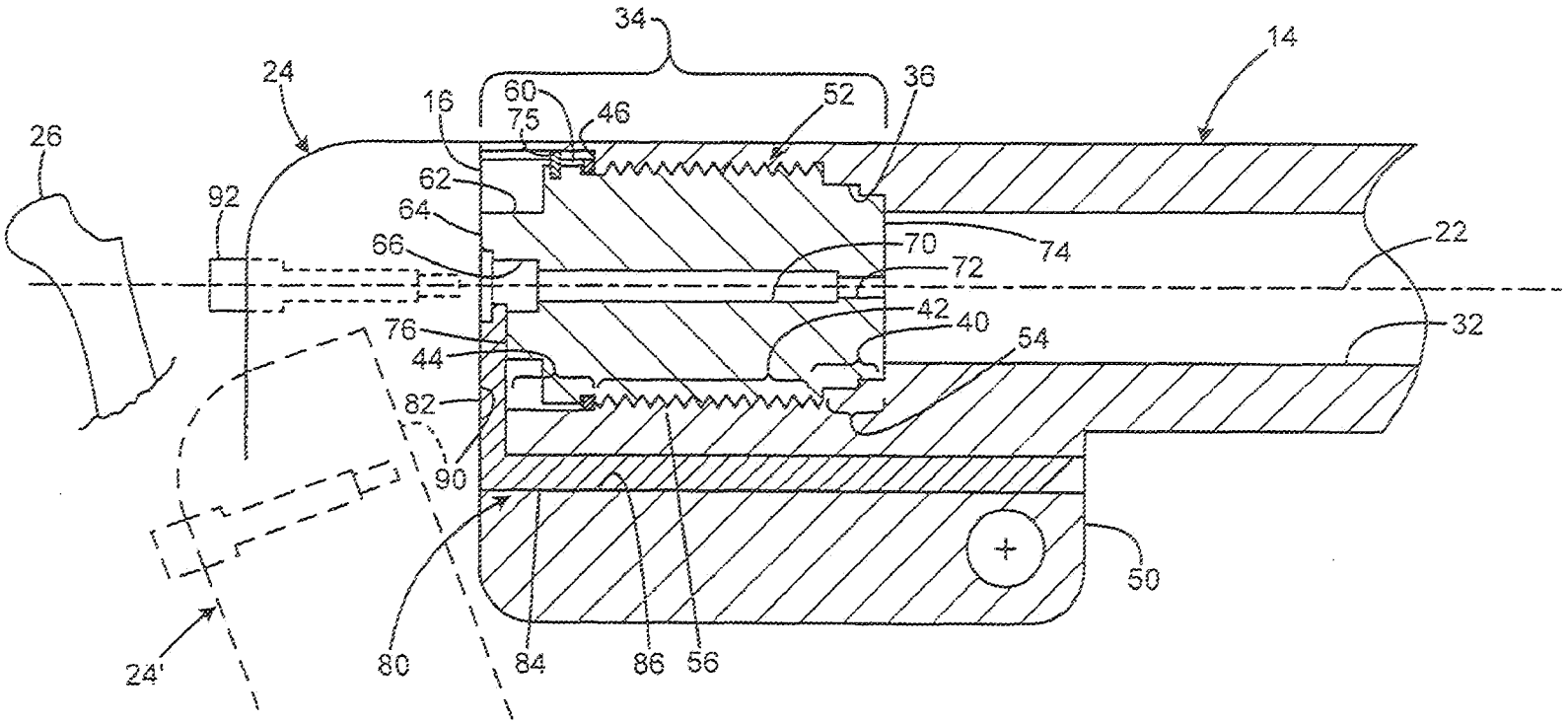
FIG. 2 is a sectional side view of the firearm of FIG. 1, taken along line 2-2 of FIG. 3.

FIG. 2 shows the breech end 16 of the barrel 14. The barrel defines a rifled bore 32 (rifling not shown) that extends from the muzzle nearly the length of the barrel, except for a rear portion 34. The rear portion of the barrel defines an enlarged breech plug chamber 36 having a stepped initial portion 40, an internally threaded intermediate portion 42, and an enlarged clearance portion 44. A shoulder 46 is formed at the rear end of the threaded portion where it meets the larger-diameter clearance portion 44. A lower lug 50 is integrally connected to a rear portion of the barrel.

The rear portion of the barrel is occupied by a breech plug 52. The breech plug is a generally cylindrical body with a nose portion 54 that is stepped to closely fit in the initial portion 40 of the breech plug chamber 36. Most of the length of the plug is provided with helical threads 56, or an alternative fastening element that provides extreme resistance to axial extraction forces, such as provided by firing a shot. The plug has a flange 60 that is larger in diameter than the threaded portion, and which rests against the shoulder 46 when installed, as shown. The rear or breech end portion of the breech plug has a hexagonal profile portion 62, in the shape of a bolt head that may be engaged by a socket wrench for removing and replacing the plug. A flat rear face 64 of the plug's hex portion is flush with the plane defined by the breech end of the barrel.

The breech plug defines a central bore having a primer pocket 66 at the breech end, a flash passage 70 from the primer pocket through most of the length of the plug, and a narrow passage 72 from the flash passage to the nose 74 or forward face of the plug. The primer pocket is generally cylindrical, to fit a standard primer for a muzzle loading rifle, with an enlarged diameter at the rearmost portion to closely accommodate the typical flanged primer. In alternative embodiments, the primer may be substituted by any other ignition device such as a number #11 or musket cap or any plastic disk or any device used to encapsulate an ignition device. The breech plug includes a pin 75 that protrudes a short distance, radially from the periphery of the flange.

Figure 3:
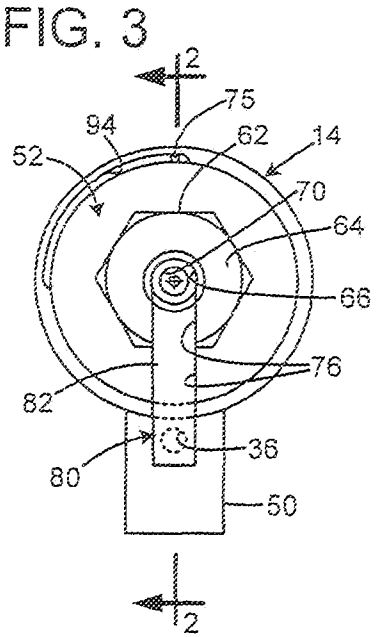
FIG. 3 is a rear view of the firearm of FIG. 1.

As shown in FIG. 3, the breech plug further defines a rectangular slot 76 that extends downwardly, perpendicularly to the bore axis 22, from the center of the primer pocket. The pin 75 protrudes in the opposite upward direction. The width of the slot is less than the diameter of the flange portion of the primer pocket, and about the same as the diameter of the main portion of the primer pocket. The depth of the slot (along a direction parallel to the barrel axis) is greater than the depth of the flange portion, but less than the depth of the primer pocket overall.

An extractor 80 is a solid body with an L-shaped form. It has a short leg 82 with a rectangular cross section that closely fits the slot 76, and a long leg 84 that has a cylindrical form, and which is closely received in a bore 86 in the lower lug that extends axially, parallel to the bore axis 22. The free end of the short leg of the extractor is formed with a curved lip that partly defines the primer pocket, with the same shape as the surface of revolution that defines the pocket. Thus, when the extractor is in the rest position shown, a primer in the pocket is closely received on all sides without substantial gaps, so that it is physically supported against rupture. Together, the rear face of the extractor leg 82 and the hex face 64 entirely encircle the primer pocket.

The extractor 80 is movable rearward to an extracted position, so that its lip draws a primer in the pocket partially from the pocket, in response to opening of the rifle action, by a linkage (not shown.) The extractor leg 82 inserts in the plug slot only when the plug is in one selected orientation, and prevents plug rotation while in that position. This aids against improper installation of the plug, and the risk that a plug may work its way out of position during shooting.

The breech element 24 is shown in the closed position in solid lines, and has a breech face 90 that abuts the barrel breech 16 and plug face 64 when closed. This provides a rear surface to fully enclose the primer pocket. A bore in the breech element along the bore axis 22 receives a firing pin 92 that is struck by the hammer 26 to fire the rifle, forcing a tip of the pin into a primer, which sends ignition gases through the plug bore, to ignite gun powder in the barrel. The breech element is shown in the open position (in which the extractor extends to eject the primer) in dashed lines 24'. The extractor is removable to allow removal of the breech plug.

As shown in FIG. 3, the enlarged clearance portion 44 includes a further enlarged track portion 94 that provides a path for receiving the protruding plug pin 75. This path limits the orientation in which the plug may be installed, ensuring that orientation errors are avoided. The track extends one-quarter of the circumference of the barrel, for applications in which one-quarter turn of the plug is required for installation (as in the embodiments of FIGS. 5 and 6). For other configurations, the track is just long enough to allow the pin to fit at one end of the track when the plug is axially inserted, and to rotate near the other end when the plug is rotatably secured, as will be discussed below. In alternative embodiments, the track may be a helical groove (or a groove associated with multi-start threads), so as to permit conventional threads to use the feature.

Figure 4:
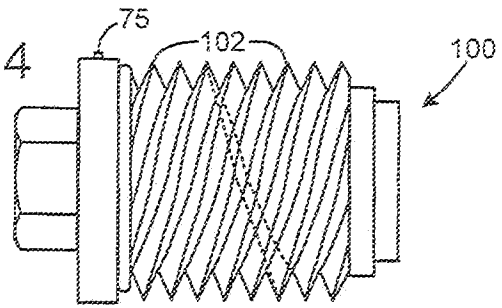
FIG. 4 is a side view of a breech plug according to a first alternative embodiment of the invention.

FIG. 4 shows an alternative breech plug 100 that differs from the plug of the embodiment above in that it employs a multistart thread configuration. In contrast to a conventional thread in which a single helix winds about a cylinder, so that the bolt advances by one thread pitch per revolution, a multistart thread has more than one thread side by side. Multistart threads are advantageous in that they combine the close fit of a fine thread with the quick axial motion of a coarse thread, both of which are desirable with the present invention as hereinbefore described. As will be readily appreciated, for a single thread, lead, the distance a bolt or the like is advanced when it is turned one revolution, is the same as the pitch, i.e., the distance from one thread to the next. For a two-start thread, the lead is twice the pitch, meaning that the bolt will advance twice as far, and therefore twice as quickly, per one revolution of the bolt compared to a single start thread having the same pitch. For a four start thread, the lead is four times the pitch, meaning the bolt will advance four times as far, and therefore four times as quickly, per one revolution of the bolt compared to a single start thread.

The effort required to free a jammed breech plug will also be reduced as the number of thread starts increases. For example, a two start thread will require approximately half of the effort or force to free the plug in the event of a jam, compared to a jammed single start thread, and a four start thread will require only approximately one quarter of the effort or force required to free the plug as compared a single start thread. In this respect, a breech plug configured with multistart threads is capable of being installed in a breech plug bore with corresponding threads much quicker than a single start thread, while still exhibiting the close fit of a single start, fine thread. In addition, much less effort is required to free the plug in the event of a jam than would be required for a single start threaded breech plug and corresponding breech plug bore.

In the embodiment shown in FIG. 4, a four, or quad, start thread is shown, having four threads in parallel with four different starting points. The breech plug bore in the barrel is machined with female versions of the same mating thread pattern. A single thread 102 is highlighted. Thus, unlike a conventional plug in which 10-15 turns are required for installation or removal, the four start thread requires only three or four. In addition, in the event that the plug becomes jammed, it will only require approximately one quarter of the effort that would ordinarily be required with a single start thread to free the plug. In alternative embodiments, the number of threads, or the multiplier may differ, from two and up. Preferably, however, the breech plug and breech plug bore will have two, three or possibly four start threads. Two or three, and possibly even four start threads are preferable because, beyond a certain number, the thread angle becomes too steep, eventually exceeding a critical angle at which the ability of the plug to resist the axial pressure during firing is lessened. Accordingly, consideration must be taken of the amount of axial force generated during firing for a particular firearm when selecting the particular thread configuration, i.e., number of thread positions. In most instances, however, two or three start threads provide the optimal balance of quick installation and removal, close fit and holding power, and minimal effort required to free the plug in the event of a jam or binding.

The threads may be of any type, including buttress, acme, or conventional as illustrated. With multi-start threads having several different possible starting points, there is an opportunity for error in installation. However, the alignment of the extractor with the plug slot 76 ensures that the installation is suitable, by timing the threads so that the final orientation corresponds to the initial orientation. Moreover, it is preferred to require an integral number of rotations for installation, so that the plug may start in the "final" rotational position, with the slot extending visibly downward to assure that the final position will be correct. In the illustrated embodiment, the threaded portion has a nominal diameter of 0.6875 inch, and the threads have a pitch of 20 threads per inch.

Figure 5:
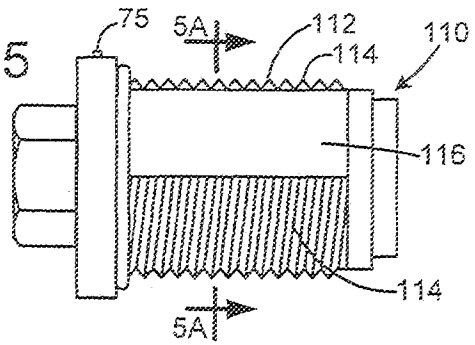
FIG. 5 is a side view of a breech plug according to a second alternative embodiment of the invention.
Figure 5A:
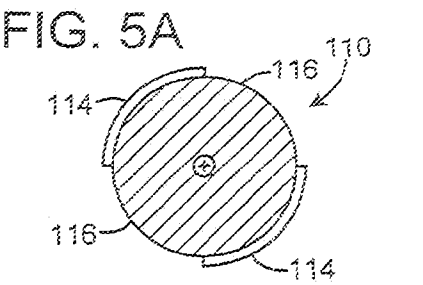
FIG. 5A is a sectional end view of the breech plug of FIG. 5.

FIGS. 5 and 5A show a further alternative breech plug 110 having an interrupted thread pattern 112. This pattern has conventional threads in axial stripes or zones 114 that alternate with areas 116 with no threads. The threadless areas 116 have a cylindrical surface at a diameter with respect to the plug axis of less than the root diameter of the threads. The breech plug bore is machined with similar alternating patterns of threaded and threadless areas, with the threaded areas mating with the threaded areas of the plug, and the unthreaded areas having a radius greater than the maximum radius of the threaded areas of the plug, so that the plug may be axially inserted with its threads passing freely through the threadless areas of the bore, and then rotated a fractional turn to engage the threads. In the illustrated embodiment, there are four zones of about 90 degrees each, the threaded zones being less, the threadless greater, to provide insertion clearance. This requires a 90-degree turn to shift from a locked position to a removable position. Alternatively, the number of threaded zones may be established at any integer "n", so that a turn angle of 360/n degrees is provided. In the illustrated embodiment, the threads have a pitch of 16 threads per inch.

Figure 6:
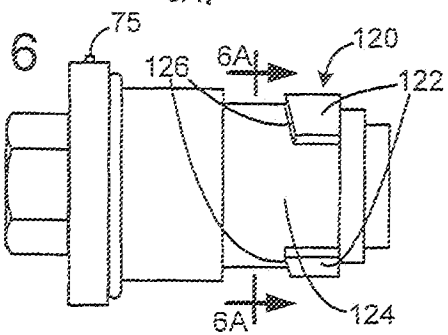
FIG. 6 is a side view of a breech plug according to a third alternative embodiment of the invention.
Figure 6A:
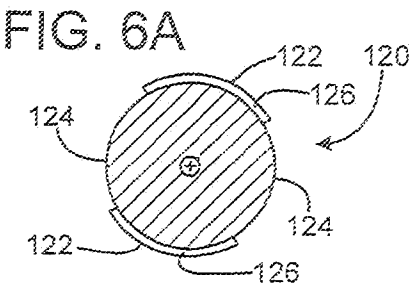
FIG. 6A is a sectional end view of the breech plug of FIG. 6.

FIGS. 6 and 6A show an alternative variant plug 120 also requiring only a fractional turn for plug extraction. In this case, the plug is configured like the bolt of a bolt-action rifle, with a pair of opposed bolt lugs 122 at the forward end of the cylindrical portion that would otherwise be threaded. The lugs are separated from each other about the circumference of the plug by sections 124 having a lesser radius, and the breech plug bore has pockets that receive the lugs by axial insertion, then rotation to engage against axial extraction. The rear surfaces 126 of the lugs are angled slightly from a circumferential line, so that they provide a wedging effect upon engagement with the similarly angled mating surfaces of the breech plug bore. In the illustrated embodiment, the rear faces are at an angle of 4 degrees from a circumferential circle.

The present invention can be used with any of the known ignition devices for muzzle loaders.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A muzzle loading firearm comprising:

a barrel with a bore defining a bore axis, and having a muzzle end and a breech end;

a breech element connected to the barrel, and having a breech face, the breech element being movable between an open position in which the breech face is away from the breech end of the barrel, and a closed position in which the breech face is in registration with the breech end of the barrel;

a breech plug removably attached to the barrel, the breech plug defining a primer pocket that is enclosed when the breech element is in the closed position, such that a primer in the pocket is fully supported on all sides; and wherein the primer pocket is at least in part defined by an extractor movably connected to the breech plug.

2. A muzzle loading firearm comprising:

a barrel with a bore defining a bore axis, and having a muzzle end and a breech end;

a breech element connected to the barrel, and having a breech face, the breech element being movable between an open position in which the breech face is away from the breech end of the barrel, and a closed position in which the breech face is in registration with the breech end of the barrel;

a breech plug removably attached to the barrel, the breech plug including a pin that protrudes radially from a periphery of a flange portion of the breech plug; and wherein the breech end of the barrel defines a breech plug chamber, the breech plug chamber having a track portion that provides a path for receiving the pin for limiting an orientation in which the plug may be installed.

3. A muzzle loading firearm comprising:

a barrel with a bore defining a bore axis, and having a muzzle end and a breech end;

a breech element connected to the barrel, and having a breech face;

the breech element being movable between an open position in which the breech face is away from the breech end of the barrel, and a closed position in which the breech face abuts the breech end of the barrel;

a breech plug removably attached to the barrel;

the breech plug defining a primer pocket and having a rear face abutting the breech face when the breech element is in the closed position; and wherein the primer pocket is at least in part defined by an extractor movably connected to the breech plug.

4. A muzzle loading firearm comprising:

a barrel with a bore defining a bore axis, and having a muzzle end and a breech end;

a breech element connected to the barrel, and having a breech face;

the breech element being movable between an open position in which the breech face is away from the breech end of the barrel, and a closed position in which the breech face abuts the breech end of the barrel;

a breech plug removably attached to the barrel;

the breech plug defining a primer pocket and having a rear face abutting the breech face when the breech element is in the closed position and including a pin that protrudes radially from a periphery of a flange portion of the breech plug; and wherein the breech end of the barrel defines a breech plug chamber, the breech plug chamber having a track portion that provides a path for receiving the pin for limiting an orientation in which the plug may be installed.

5. A muzzle loading firearm comprising:

a barrel with a bore defining a bore axis, and having a muzzle end and a breech end;

a breech element connected to the barrel, and having a breech face;

the breech element being movable between an open position in which the breech face is away from the breech end of the barrel, and a closed position in which the breech face abuts the breech end of the barrel;

a breech plug removably attached to the barrel;

the breech plug defining a primer pocket and having a rear face abutting the breech face when the breech element is in the closed position, the rear face of the breech plug entirely encircling the primer pocket;

a movable extractor forming part of the rear face of the breech plug; and a slot formed in the rear face of the breech plug that extends perpendicular to the bore axis from the primer pocket.

6. The muzzle loading firearm of claim 5, wherein:

the slot is configured so as to receive a leg portion of the extractor only when the plug is in a selected orientation and to prevent rotation of the plug when in said orientation.

* * * * *